US009629451B2

(12) United States Patent
Harper

(10) Patent No.: US 9,629,451 B2
(45) Date of Patent: Apr. 25, 2017

(54) ARTICLE OF FURNITURE HAVING A FOLDING MECHANISM

(71) Applicant: Knoll, Inc., East Greenville, PA (US)

(72) Inventor: Michael Harper, Bethlehem, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 15/097,317

(22) Filed: Apr. 13, 2016

(65) Prior Publication Data

US 2016/0316904 A1 Nov. 3, 2016

Related U.S. Application Data

(60) Provisional application No. 62/155,750, filed on May 1, 2015.

(51) Int. Cl.

| | |
|---|---|
| ***A47B 3/00*** | (2006.01) |
| ***A47B 3/087*** | (2006.01) |
| ***A47C 4/00*** | (2006.01) |
| ***A47B 3/083*** | (2006.01) |
| *A47B 3/091* | (2006.01) |

(52) U.S. Cl.

CPC ..... *A47B 3/087* (2013.01); *A47B 3/083* (2013.01); *A47C 4/00* (2013.01); *A47B 3/0911* (2013.01)

(58) Field of Classification Search

CPC ..... A47B 3/087; A47B 3/083; A47B 3/00; A47B 3/14; A47B 3/02; A47B 5/04; A47B 31/04; A47B 9/02; A47C 4/00; Y10T 16/5386; Y10T 16/53862; Y10T 16/5389

USPC ..... 108/166–169, 171–174, 115, 124, 67, 108/136; 16/298, 299, 308; 248/188.6, 248/439

See application file for complete search history.

(56) References Cited

U.S. PATENT DOCUMENTS 1,638,805 A * 8/1927 Hausman ..... A47B 5/04 108/115

2,721,778 A 10/1955 Wilson (Continued)

FOREIGN PATENT DOCUMENTS

CH 360185 * 2/1962

DE 19847396 A1 4/2000

(Continued)

OTHER PUBLICATIONS

International Search Report of the International Searching Authority for PCT/US2016/027414 dated Jul. 5, 2016.

(Continued)

*Primary Examiner* — Janet M Wilkens

(74) *Attorney, Agent, or Firm* — Buchanan Ingersoll & Rooney PC

(57) ABSTRACT

An article of furniture can include a base attached to a frame to support the frame on a floor. A tabletop may be attached to the frame. The frame and/or the tabletop may be attached to a folding mechanism so that first and second sections of the tabletop are moveable so that the tabletop is adjustable from an unfolded position to a folded position and vice versa. The folding mechanism may include a plurality of spring elements connected to a plurality of hinges that are configured to help control an amount of force needed for adjusting the tabletop's position and the rate of speed at which the tabletop is rotatable between its folded and unfolded positions.

16 Claims, 10 Drawing Sheets

(56) References Cited

U.S. PATENT DOCUMENTS

| | | | | | |
|---|---|---|---|---|---|
| 2,747,958 | A * | 5/1956 | Wilson | A47B 3/087 | 108/169 |
| 2,841,724 | A * | 7/1958 | Brown | E05F 15/686 | 160/189 |
| 2,878,859 | A * | 3/1959 | Howe | A47B 3/14 | 108/99 |
| 3,075,809 | A * | 1/1963 | Wilson | A47B 3/14 | 108/173 |
| 3,143,982 | A * | 8/1964 | Blink | A47B 3/087 | 108/130 |
| 3,159,114 | A * | 12/1964 | Haunost | A47B 3/087 | 108/173 |
| 3,276,401 | A * | 10/1966 | Wilson | A47B 3/087 | 108/169 |
| 3,715,143 | A * | 2/1973 | Gerken | A47B 3/14 | 108/173 |
| 3,884,160 | A * | 5/1975 | Gutierrez | A47B 3/087 | 108/169 |
| 4,027,600 | A * | 6/1977 | Mueller | A47B 3/083 | 108/169 |
| 4,054,096 | A * | 10/1977 | Wilson | E04H 3/28 | 108/169 |
| 4,932,333 | A * | 6/1990 | Jensen | A47B 3/14 | 108/175 |
| 6,164,217 | A | 12/2000 | Prendergast | | |
| 6,223,661 | B1 * | 5/2001 | Griepentrog | A47B 3/14 | 108/115 |
| 6,637,352 | B1 | 10/2003 | Thode et al. | | |
| 6,845,723 | B2 | 1/2005 | Kottman et al. | | |
| 7,066,098 | B2 | 6/2006 | Blasen et al. | | |
| 7,171,911 | B1 * | 2/2007 | Rivera, Jr. | A47B 3/14 | 108/115 |
| 7,195,300 | B2 * | 3/2007 | Austin | B62D 33/0273 | 16/308 |
| 7,546,663 | B2 * | 6/2009 | Duffy | E05F 1/1016 | 16/296 |
| 7,614,351 | B2 | 11/2009 | Piretti | | |
| 7,712,422 | B2 | 5/2010 | Bue | | |
| 7,845,290 | B2 | 12/2010 | Piretti | | |
| 7,878,128 | B2 | 2/2011 | Watson et al. | | |
| 8,051,784 | B2 | 11/2011 | Hsu | | |
| 8,069,795 | B1 | 12/2011 | Williams et al. | | |
| 8,091,488 | B2 | 1/2012 | Chirea et al. | | |
| 8,171,863 | B2 | 5/2012 | Nyenhuis et al. | | |
| 8,297,208 | B2 | 10/2012 | Hoffman | | |
| 8,359,983 | B2 | 1/2013 | Williamson et al. | | |
| 8,413,593 | B2 | 4/2013 | Korb | | |
| 8,424,160 | B2 * | 4/2013 | Chen | E05D 11/084 | 16/278 |
| 8,555,791 | B2 * | 10/2013 | Jin | A47B 3/0818 | 108/127 |
| 8,578,864 | B2 | 11/2013 | Nyenhuis et al. | | |
| 8,869,715 | B2 | 10/2014 | Hoffman | | |
| 9,265,340 | B2 | 2/2016 | Krusin | | |
| 2005/0161984 | A1 * | 7/2005 | Bue | A47B 3/14 | 297/158.4 |
| 2008/0196635 | A1 | 8/2008 | Piretti | | |
| 2013/0233210 | A1 * | 9/2013 | Jin | A47B 3/087 | 108/166 |
| 2016/0010376 | A1 * | 1/2016 | DeVriendt | A47B 3/14 | 16/374 |

FOREIGN PATENT DOCUMENTS

| | | | |
|---|---|---|---|
| DE | 10152025 | C1 | 1/2003 |
| EP | 1157633 | A1 | 11/2001 |
| JP | 2999185 | B1 | 1/2000 |

OTHER PUBLICATIONS

Written Opinion of the International Searching Authority for PCT/US2016/027414 dated Jul. 5, 2016.

* cited by examiner

ARTICLE OF FURNITURE HAVING A FOLDING MECHANISM

CROSS-REFERENCE TO RELATED APPLICATIONS

The present application claims priority to U.S. Provisional patent application No. 62/155,750, which was filed on May 1, 2015.

FIELD OF INVENTION

The innovation relates to articles of furniture, such as tables and desks.

BACKGROUND OF THE INVENTION

Tables and other articles of furniture are often configured to have a number of legs that support a surface. For instance, tables may have legs or another type of base that supports a tabletop and a desk may have legs or another type of base that supports desktop. Examples of articles of furniture may be appreciated from U.S. Pat. Nos. 6,164,217, 6,637,352, 6,845,723, 7,066,098, 7,614,351, 7,712,422, 7,845,290, 7,878,128, 8,051,784, 8,069,795, 8,091,488, 8,171,863, 8,297,208, 8,359,983, 8,413,593, 8,578,864, and 8,869,715 and U.S. Pat. App. Pub. No. 2008/0196635. U.S. Pat. No. 9,265,340 also discloses an example of an article of furniture and mechanisms that may be used in articles of furniture.

Some types of tables, desks, chairs and other kinds of furniture may be folded to be stored to preserve space. For instance, folding chairs may be configured to be folded from a configuration in which a seat is positioned for seating to a folded position in which the seat is oriented vertically to provide a structure that takes up less floor area so that multiple folding chairs can be compactly nested or stacked on top of each other. As another example, tables may be configured to be folded so that legs of the table fold under a tabletop so that the table may be stored in a more compact configuration that requires less space for the storage of the table. Such folded tables may also be stacked on top of each other or placed next to each other for storage.

But, articles of furniture that are configured to be moved from a use position into a more compact configuration for storage can often be problematic. For instance, tables that are designed to be easily folded can also allow a user to accidentally have their finger caught in a pinch point when adjusting a table from a use position to a folded position or vice versa.

SUMMARY OF THE INVENTION

An article of furniture, a folding mechanism for an article of furniture, and a method of using such an article of furniture and/or such a folding mechanism are provided. In some embodiments, an article of furniture may include a folding mechanism that is actuatable to unlock a position of a structure so that the structure is moveable from a use position to a storage position, such as a stacking position, nesting position, or other type of storage position. In some embodiments of the method, use of an embodiment of such a folding mechanism may occur prior to the structure being moved from a use position to a storage position. Embodiments of the method may also permit actuation or use of such a folding mechanism to return the article to its use position for use after having been moved to a storage position and placed in a location for storage.

In some embodiments, an article of furniture can include a base, a frame connected to the base, a tabletop connected to the frame, and a folding mechanism connected to at least one of the frame and the tabletop such that a first section of the tabletop and a second section of the tabletop are moveable relative to each other so that the tabletop is moveable from an unfolded position to a folded position. The folding mechanism can include a plurality of hinges and a plurality of spring elements attached to the hinges.

In some embodiments, the hinges can comprise a first hinge and a second hinge and the spring elements can comprise a first spring element, a second spring element, a third spring element, and a fourth spring element. The first and second hinges may be spaced apart from each other. The first spring element can be connected to a first portion of the first hinge and the second spring element can be connected to a second portion of the first hinge. The third spring element can be connected to a first portion of the second hinge and the fourth spring element can be connected to a second portion of the second hinge. Each of the spring elements can be configured as a torsion spring or may be configured as another type of spring element (e.g. elastomeric spring element, etc.).

In some embodiments, the article of furniture can be configured so that the hinges include a first hinge, a second hinge, and a third hinge. The second hinge can be located between the first and third hinges. The hinges can be spaced apart from each other. Each of the hinges can have a first portion that is rotatable relative to a second portion about an axis of rotation. The axis of rotation of the first hinge can be aligned with the axis of rotation of the second hinge and the axis of rotation of the third hinge to define an axis of rotation about which the first section of the tabletop is rotatable when the tabletop is moved from the unfolded position to the folded position. For instance, the axis of rotation of the first hinge can be linearly aligned with the axis of rotation of the second hinge and also linearly aligned with the axis of rotation of the third hinge.

The folding mechanism can also include other elements. For instance, the folding mechanism can include a plurality of arms. In some embodiments, the arms may include a first arm, a second arm, a third arm, and a fourth arm. The first and third arms may be attached to a first section of the tabletop and the second and fourth arms may be attached to the second section of the tabletop. For such embodiments that also include first, second and third hinges, the spring elements may be arranged so that there is at least a first spring element connected between the first portion of the first hinge and the second arm, a second spring element connected between the second portion of the first hinge and the first arm, a third spring element connected between the first portion of the third hinge and the fourth arm, a fourth spring element connected between the second portion of the third hinge and the third arm, a fifth spring element connected between the second portion of the second hinge and the first arm, a sixth spring element connected between the second portion of the second hinge and the third arm, a seventh spring element connected between the first portion of the second hinge and the second arm, and an eight spring element connected between the first portion of the second hinge and the fourth arm. The first arm can be positioned to extend between the second portion of the first hinge and the second portion of the second hinge below the tabletop when the tabletop is in the unfolded position, the second arm extends between the first portion of the first hinge and the first portion of the second hinge below the tabletop when the tabletop is in the unfolded position, the third arm can be positioned to extend between the second portion of the second hinge and the second portion of the third hinge below the tabletop when the tabletop is in the unfolded position, and the fourth arm can be positioned to extend between the first portion of the second hinge and the first portion of the third hinge below the tabletop when the tabletop is in the unfolded position. The first arm can be spaced apart from the second arm and the fourth arm can be spaced apart from the third arm. In some embodiments, the first and third arms may be separate arms and in other embodiments they may be segments of a unitary structure (e.g. a beam, rail, rod, or other type of arm-like structure). The second and fourth arms may also be separate arms or may be segments of a unitary structure (e.g. a beam, rod, rail or other type of arm-like structure).

In some embodiments, the frame can include a first cross member positioned adjacent to the first portion of the second hinge and a second cross member positioned adjacent to the second portion of the second hinge. The first cross member may also be positioned adjacent to the first portions of the first and third hinges. The second cross member may also be positioned adjacent to the second portions of the first and third hinges. In embodiments where there is only first and second hinges, the first cross member be positioned adjacent to the first portions of the first and second hinges and the second cross member may be positioned adjacent to the second portions of the first and second hinges.

The folding mechanism can also include other elements. For instance, the folding mechanism can also include a first elongated member extending from the first cross member to a first leg such that a first end of the first elongated member is rotatably connected to the first cross member and a second end of the first elongated member is rotatably connected to the first leg. The folding mechanism can also include a second elongated member extending from the second cross member to the second leg such that a first end of the second elongated member is rotatably connected to the second cross member and a second end of the second elongated member is rotatably connected to the second leg. The folding mechanism can also include spring elements connected to these elongated members. For instance, there may be a ninth spring element connected between the second end of the first elongated member and the first leg and a tenth spring element connected between the second end of the second elongated member and the second leg. These spring elements may be torsion springs or another type of spring element.

The base can be configured to include a number of different arrangements and structures for supporting the tabletop on a floor. For instance, the base can include a first leg and a second leg. In other embodiments, the base may include more than two legs (e.g. a third leg, a fourth leg, etc.). The base can also include feet attached to the legs. The feet can be castors or glides in some embodiments.

The frame can have a number of different configurations. In some embodiments, the frame can include a first portion connected to the first section of the tabletop and a second portion connected to the second section of the tabletop such that proximate edges of the first and second sections of the tabletop contact each other or are proximate each other when the tabletop is in the unfolded position such that the proximate edges face each other when the tabletop is in the unfolded position and the proximate edges are moved away from each other when the tabletop is adjusted from the unfolded position to the folded position such that the proximate edges face in a same direction when the tabletop is in the folded position.

The article of furniture can be configured as a table such as a moveable table. In other embodiments, it is contemplated that the article of furniture may be a desk, a counter, a bench or other article.

The article of furniture can also include a locking device connected to at least one of the frame and the folding mechanism. The locking device can be adjustable from a locked position to an unlocked position and vice versa. The locking device can be configured to prevent the tabletop from moving from the unfolded position to the folded position when in the locked position.

In some embodiments, the article of furniture may be configured so that there is a first hinge and a second hinge and the article also includes a first arm, a second arm, a third arm, and a fourth arm, and the spring elements include a first spring element connected between a first portion of the first hinge and the second arm, a second spring element connected between a second portion of the first hinge and the first arm, a third spring element connected between a first portion of the second hinge and the fourth arm, and a fourth spring element connected between a second portion of the second hinge and the third arm. There may also be a first gear assembly connected between the first portion of the first hinge and the second portion of the first hinge and a second gear assembly connected between the first portion of the second hinge and the second portion of the second hinge. The first portion of the first hinge can be rotatable relative to the second portion of the first hinge about an axis of rotation and the first portion of the second hinge can be rotatable relative to the second portion of the second hinge about an axis of rotation. The axis of rotation of the first hinge can be aligned with the axis of rotation of the second hinge to define an axis of rotation about which the first section of the tabletop is rotatable when the tabletop is moved from the unfolded position to the folded position. For such embodiments, it is contemplated that the first arm is positioned below the tabletop when the tabletop is in the unfolded position, the second arm is positioned below the tabletop when the tabletop is in the unfolded position, the third arm is positioned below the tabletop when the tabletop is in the unfolded position, and the fourth arm is positioned below the tabletop when the tabletop is in the unfolded position. The fourth arm can be spaced apart from the third arm and the first arm can be spaced apart from the second arm.

A method of using any embodiment of the article of furniture is also provided. The method can include the steps of adjusting the tabletop from the unfolded position to the folded position and adjusting the tabletop from the folded position to the unfolded position. The adjusting of the tabletop from the unfolded position to the folded position can be performed such that a height of the hinges is increased while legs of the article of furniture are moved closer together and the adjusting of the tabletop from the folded position to the unfolded position can be performed such that the height of the hinged decreases while the legs of the article of furniture are moved away from each other.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of an article of furniture having a folding mechanism and embodiments of the folding mechanism are shown in the accompanying drawings and certain exemplary methods of practicing the same are also illustrated therein. It should be appreciated that like reference numbers used in the drawings may identify like components.

DETAILED DESCRIPTION OF EXEMPLARY EMBODIMENTS

Figure 1:
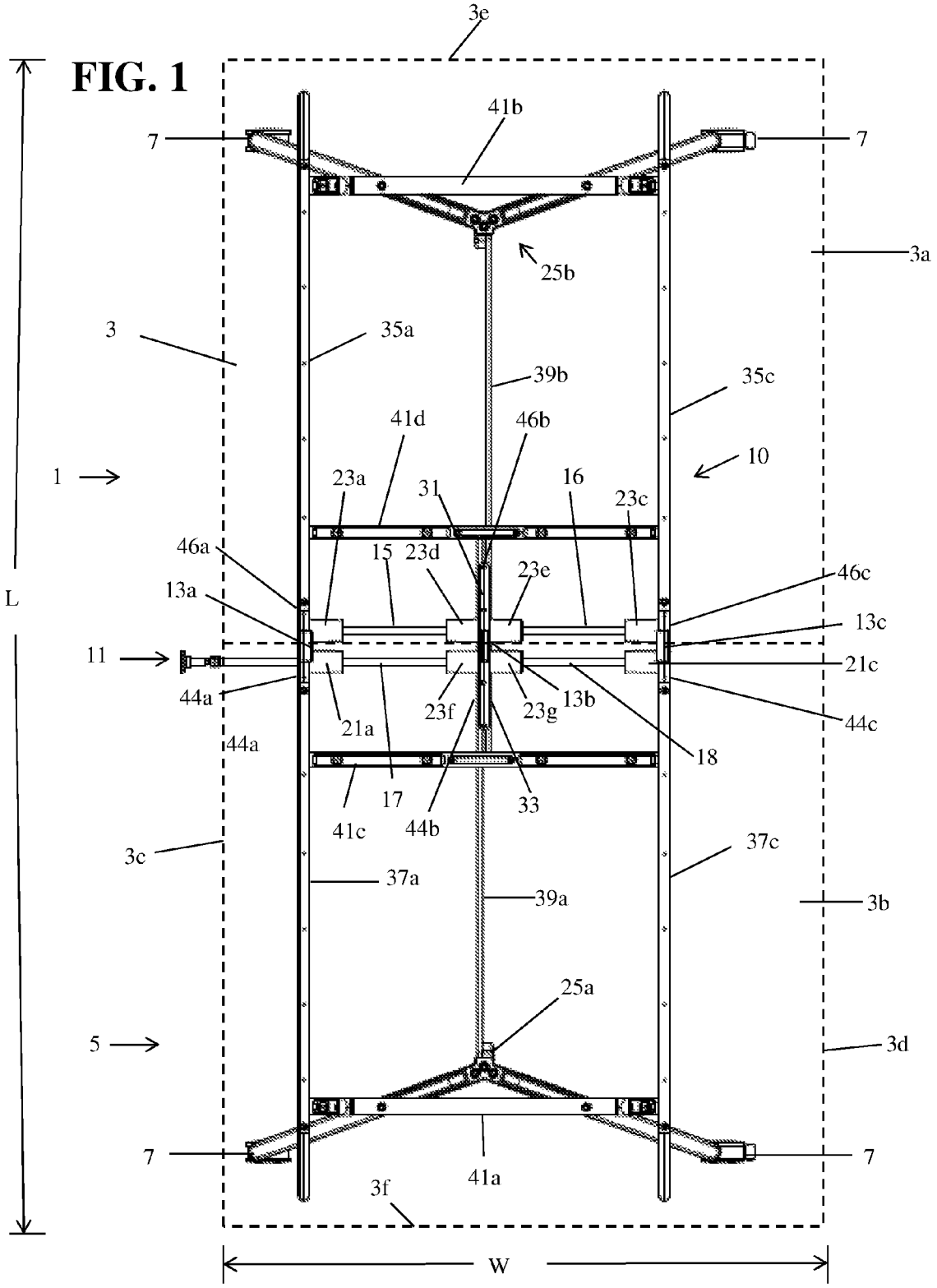
FIG. 1 is a top view of a first exemplary embodiment of the article of furniture in a first position. A tabletop 3 for the first exemplary embodiment of the article of furniture is shown schematically in broken line in FIG. 1 to allow elements of the folding mechanism of the article of furniture to be more clearly seen.
Figure 2:
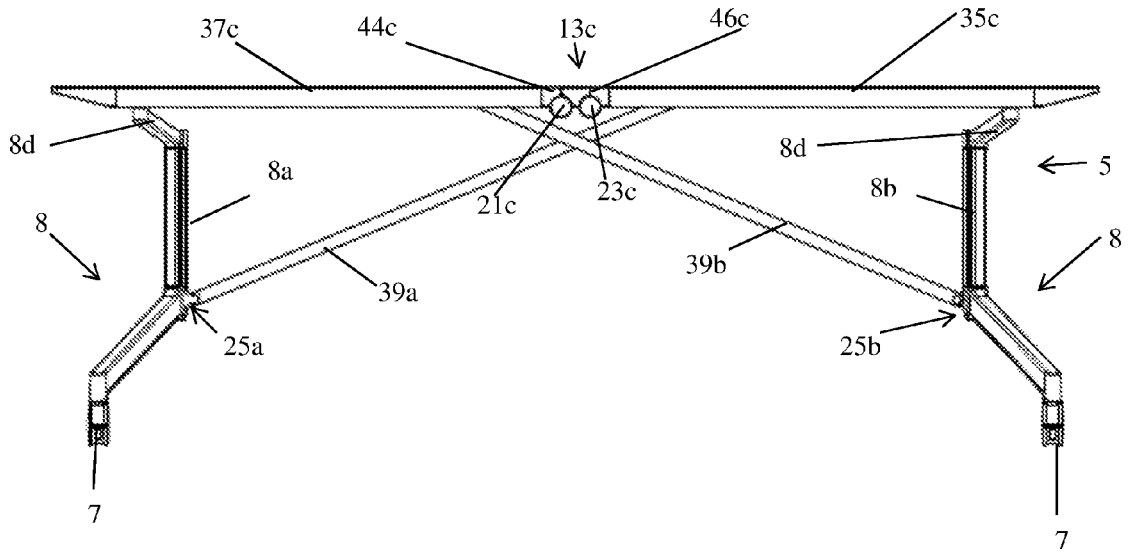
FIG. 2 is a side view of the first exemplary embodiment of the article of furniture in the first position with the tabletop 3 cut away to better illustrate elements of the folding mechanism of the article of furniture.
Figure 3:
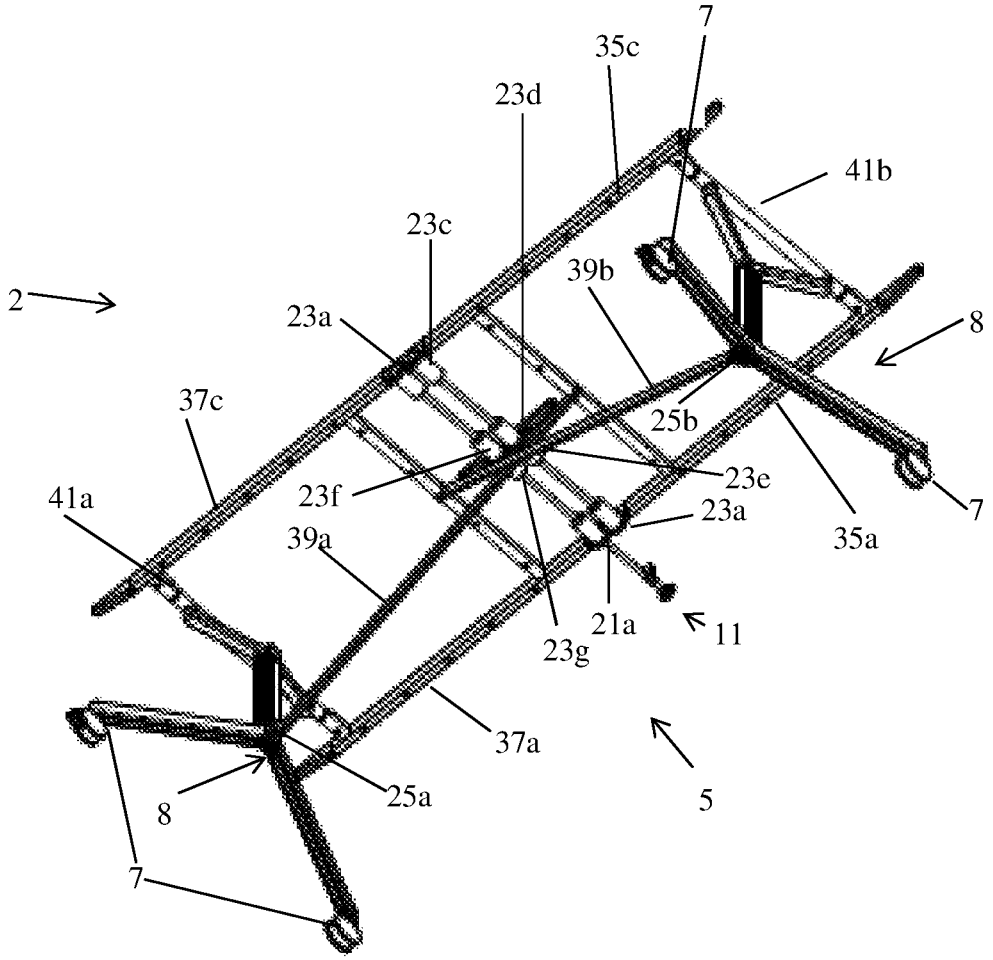
FIG. 3 is a perspective view of the first exemplary embodiment of the article of furniture in the first position with the tabletop 3 cut away to better illustrate elements of the folding mechanism of the article of furniture.
Figure 4:
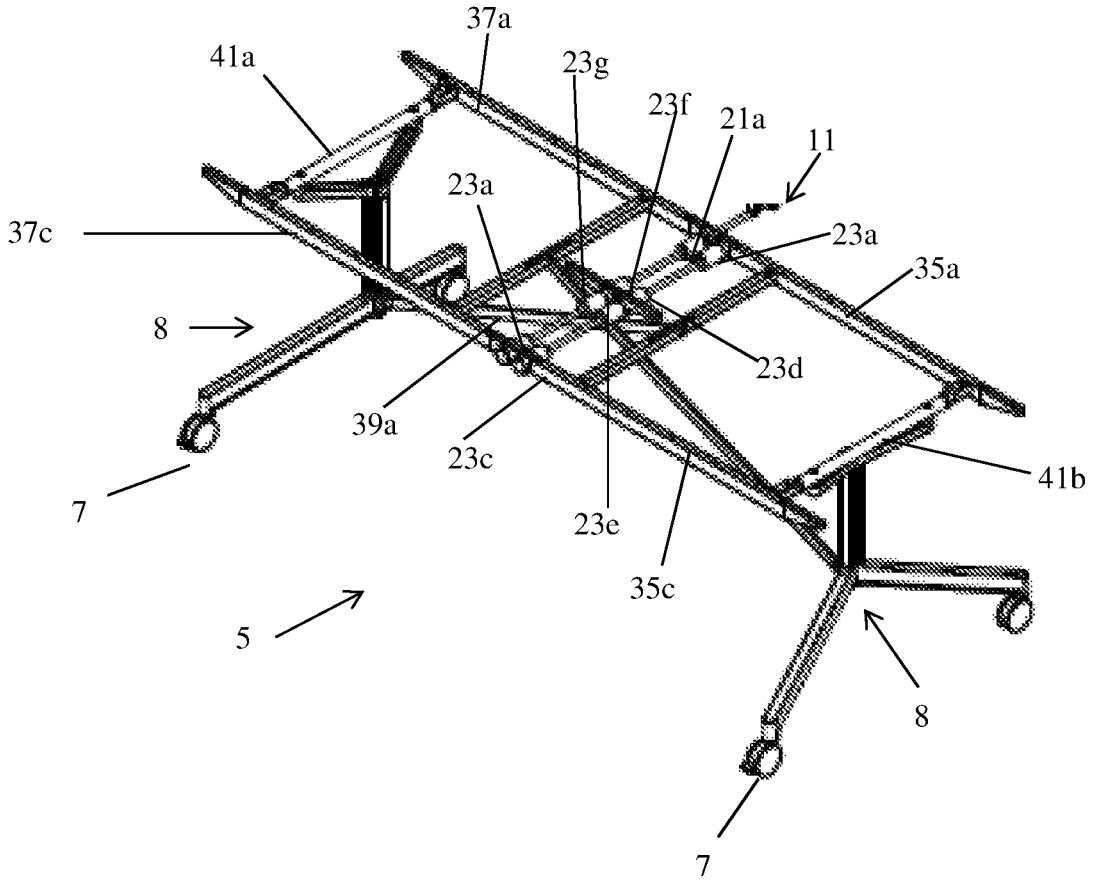
FIG. 4 is a perspective view of the first exemplary embodiment of the article of furniture in the first position with the tabletop 3 cut away to better illustrate elements of the folding mechanism of the article of furniture.
Figure 5:
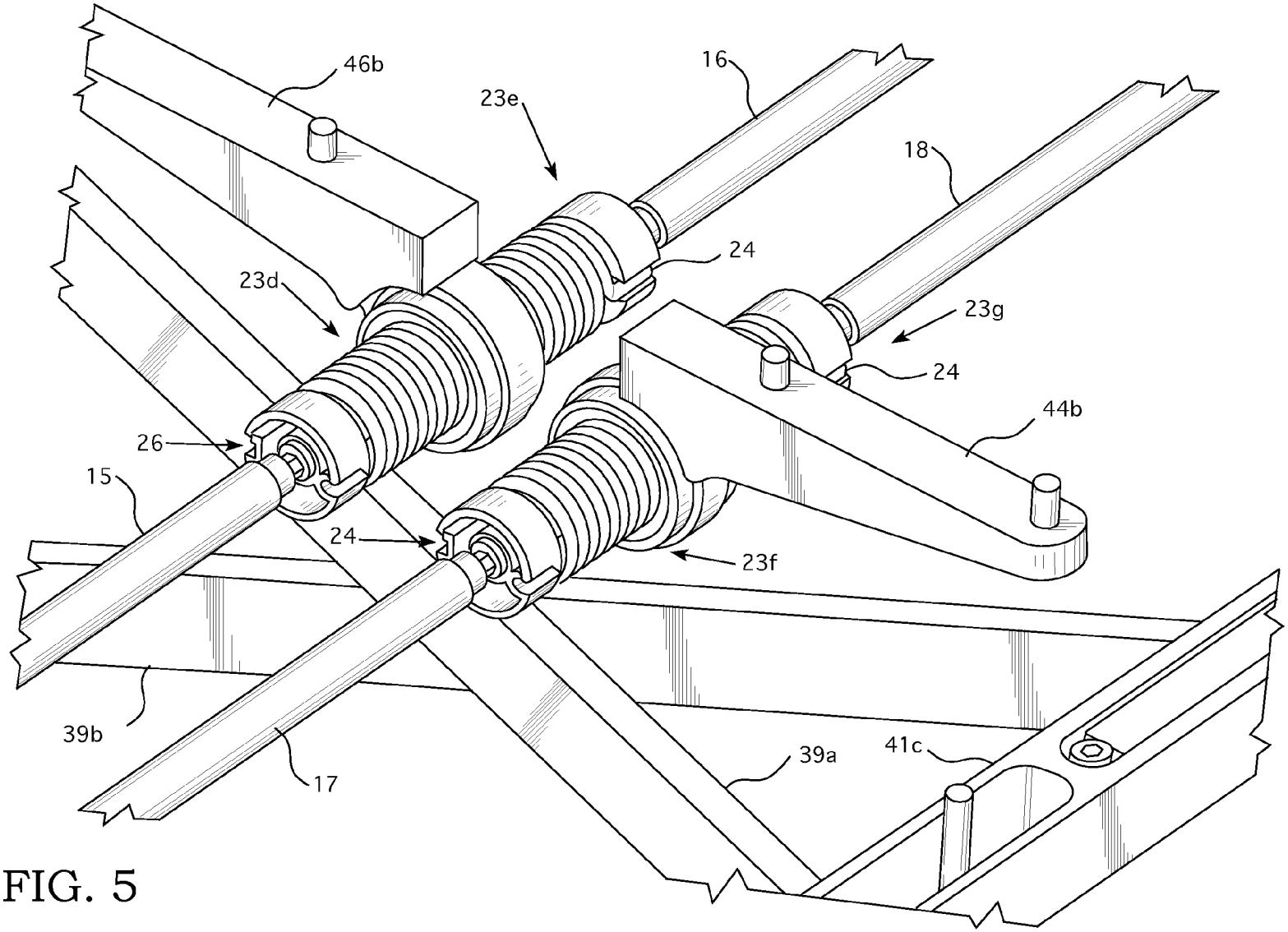
FIG. 5 is a fragmentary view of the folding mechanism of the first exemplary embodiment of the article of furniture. Enclosure elements that may be included in the folding mechanism to house spring elements and/or other elements are cut away for illustration of these enclosed components.
Figure 6:
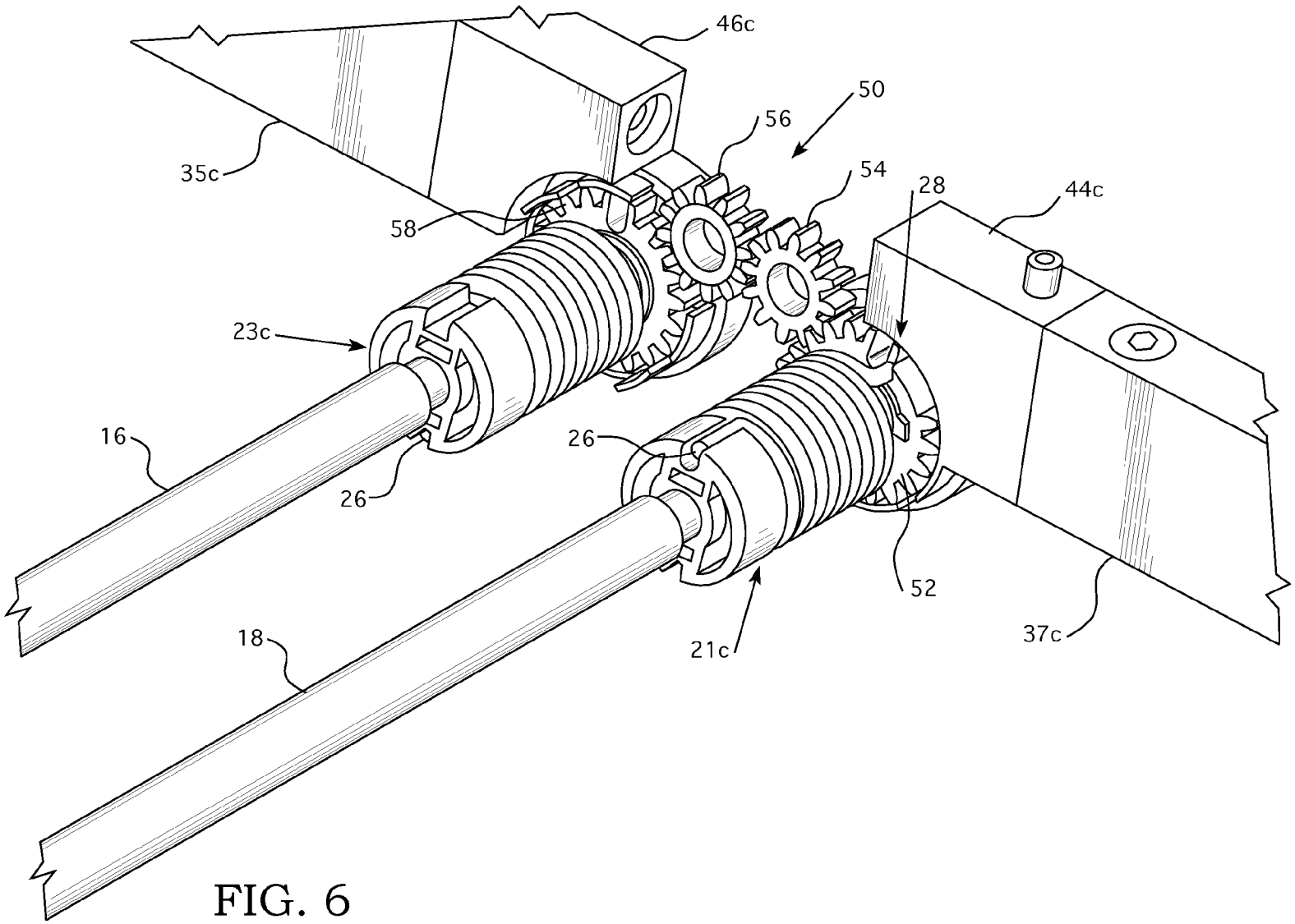
FIG. 6 is a fragmentary view of the folding mechanism of the first exemplary embodiment of the article of furniture. Enclosure elements that may be included in the folding mechanism to house spring elements and/or other elements are cut away for illustration of these enclosed components.
Figure 7:
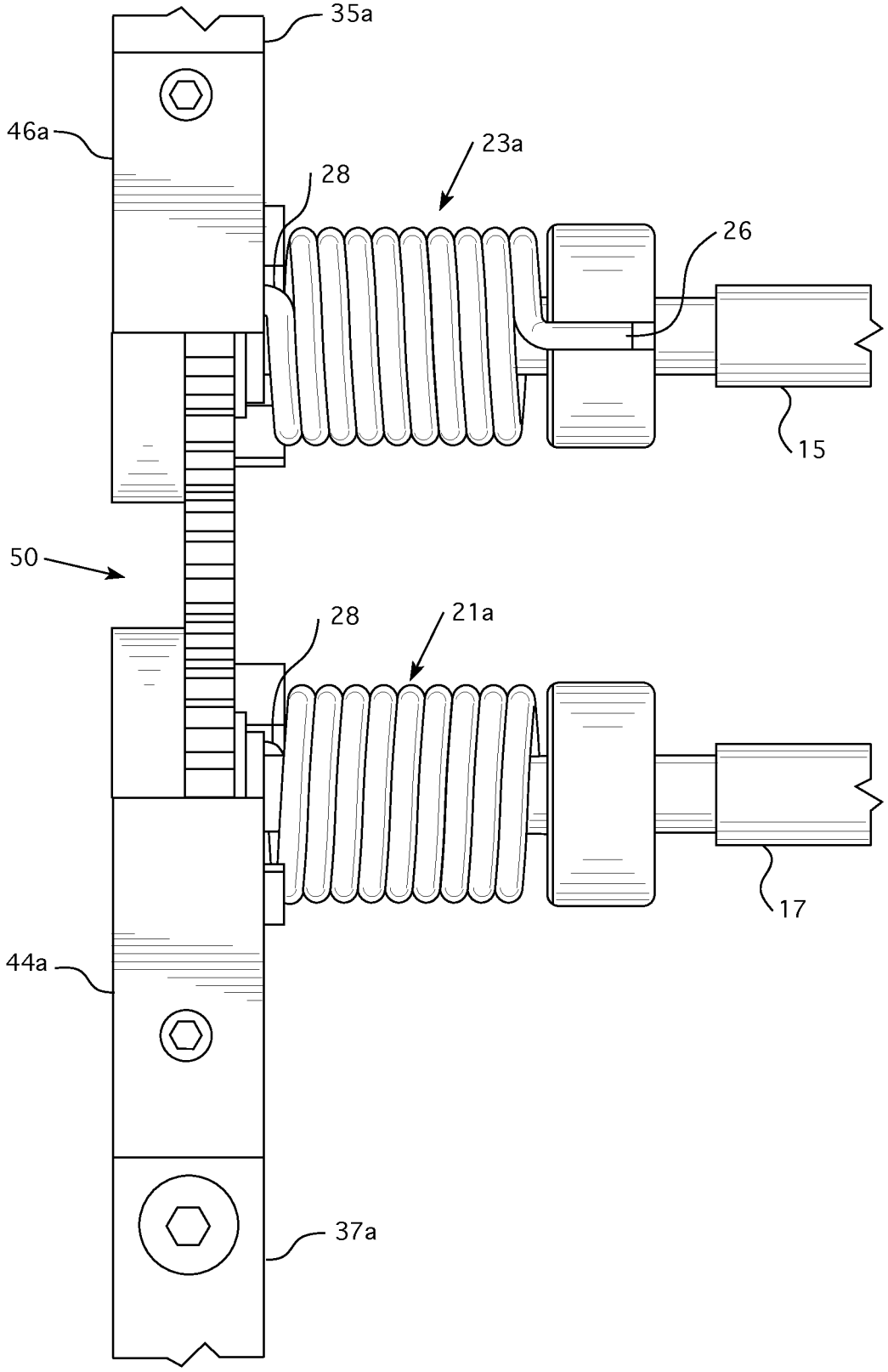
FIG. 7 is a fragmentary view of the folding mechanism of the first exemplary embodiment of the article of furniture. Enclosure elements that may be included in the folding mechanism to house spring elements and/or other elements are cut away for illustration of these enclosed components.
Figure 8:
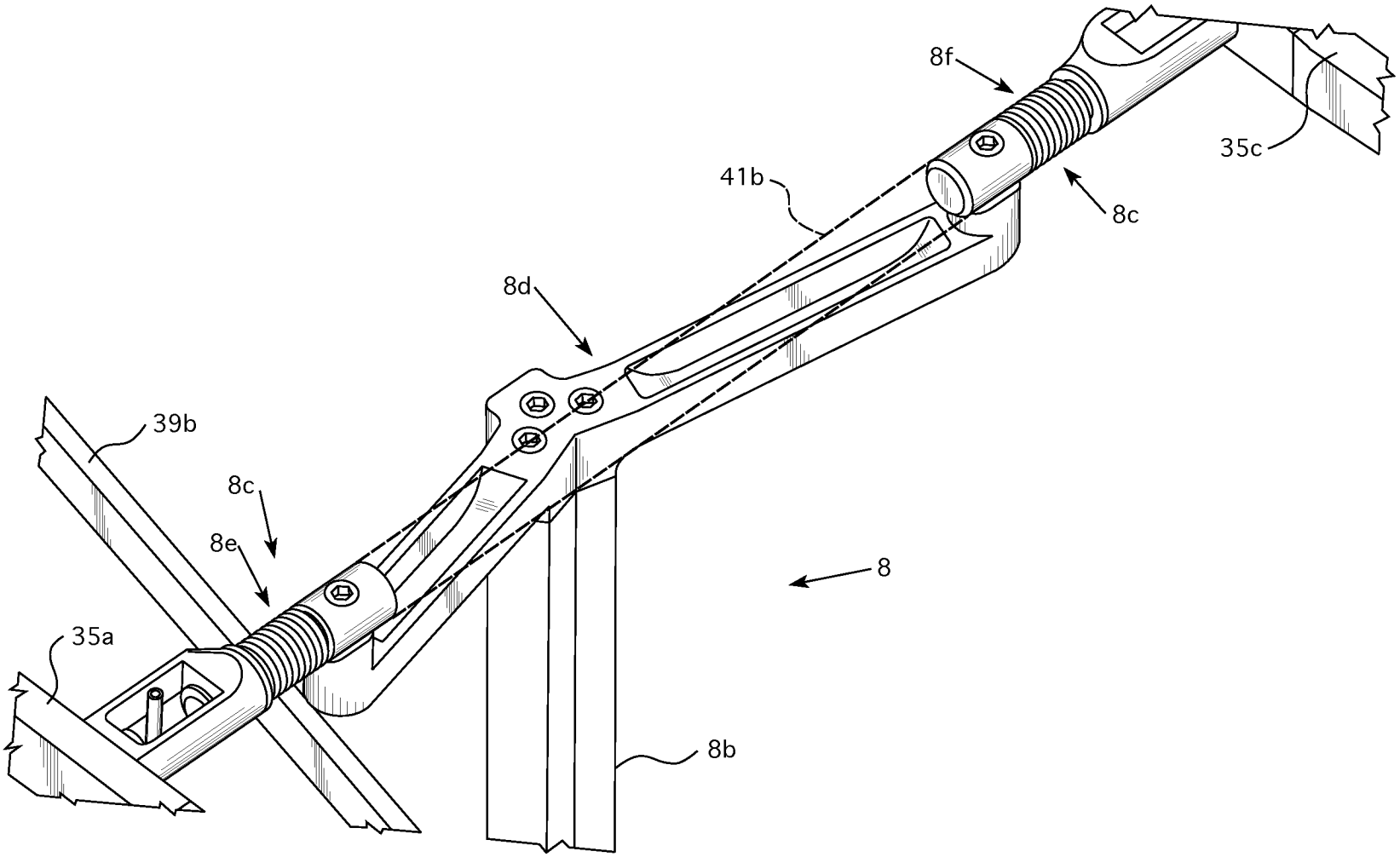
FIG. 8 is a fragmentary view of the folding mechanism of the first exemplary embodiment of the article of furniture. Enclosure elements that may be included in the folding mechanism to house spring elements and/or other elements are cut away for illustration of these enclosed components.
Figure 9:
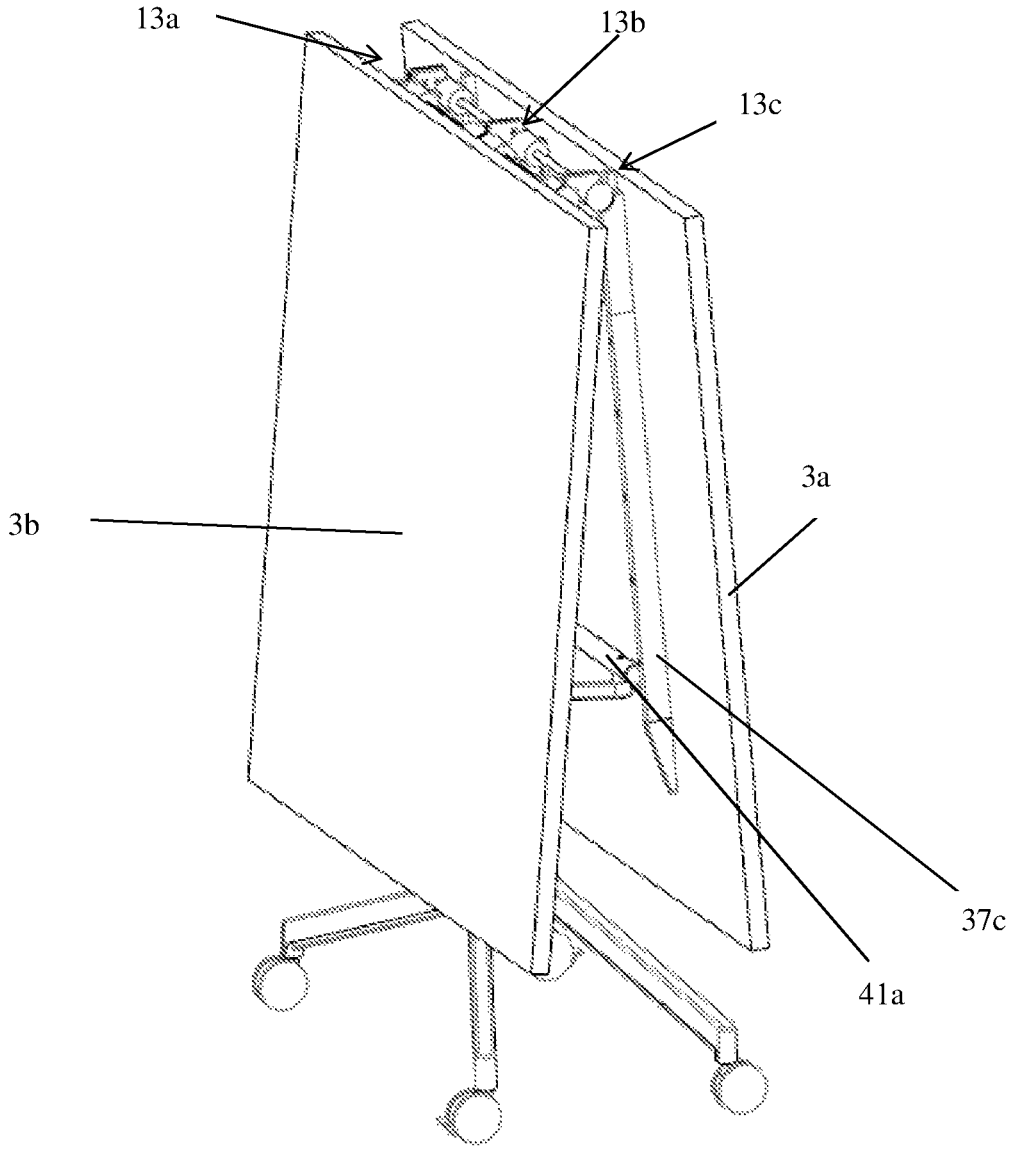
FIG. 9 is a perspective view of the first exemplary embodiment of the article of furniture in a folded position.
Figure 10:
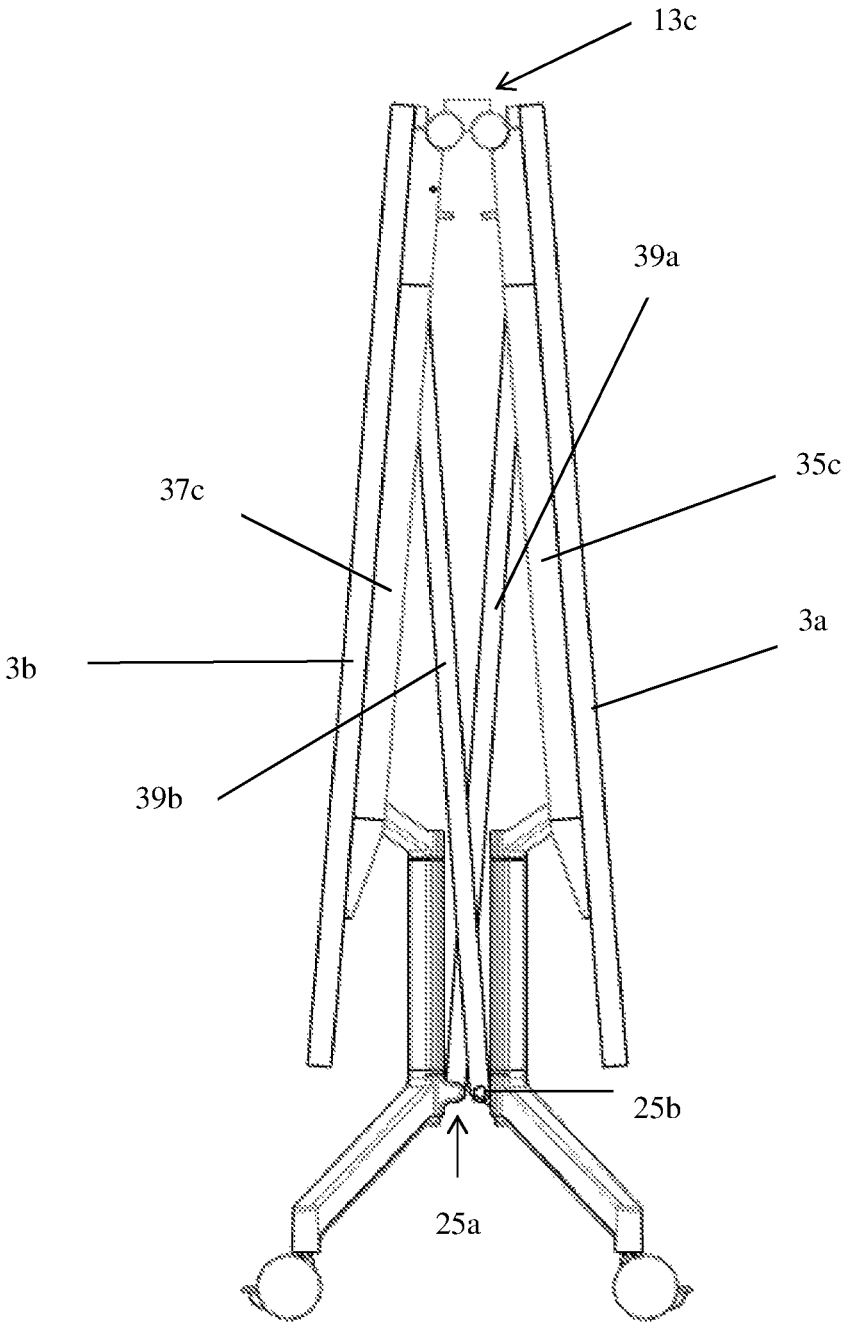
FIG. 10 is a side view of the first exemplary embodiment of the article of furniture in the folded position.

Referring to FIGS. 1-10 an article of furniture 1 can include a tabletop 3 that is supported by a base 5. The article of furniture 1 may be structured as a table, a desk, or other type of article of furniture. If the article of furniture is configured as a desk, the tabletop 3 may be considered a desktop.

The base can include feet 7. The feet 7 may be floor contacting structures, such as castors that are rollable along a floor or non-moving floor contacting structures such as pads or glider pads. The feet 7 may be attached to legs 8 or other elements of the base 5. The legs 8 can extend to a frame 2 that is configured to attach the legs 8 to the tabletop 3 so that the feet 7 and legs 8 can support the tabletop 3 when the article of furniture is in a use position, such as the first position shown in FIGS. 1-4. In some embodiments, the base 5 can include vertically elongated legs 8 may be attached to horizontally elongated support members 8*d* that are configured to attach the legs to the frame 2 for supporting the frame 2 and the tabletop 3.

The first position of the tabletop 3 may orient the tabletop so that it is horizontal or substantially horizontal (e.g. has an upper surface that is horizontal, has an upper surface that is within 10° of being horizontal as it extends along the length L of the tabletop 3, or has an upper surface within 5° of being horizontal as it extends along the length L of the tabletop 3 and also as it extends along the width W of the tabletop). For example, a first edge 3*c* of the tabletop at a first side of the tabletop 3 may be at the same or substantially the same height as a second edge 3*d* of the second side of the tabletop that is opposite the first side of the tabletop (e.g. within 25 centimeters, within 15 centimeters, etc.). A front end 3*e* and a rear end 3*f* of the tabletop 3 that may be located between the first and second sides may also each have edges that are at the same height or substantially the same height as the height of the first and second edges 3*c* and 3*d* of the first and second sides of the tabletop 3 (e.g. within 25 centimeters, within 15 centimeters, etc.).

The frame 2 of the article of furniture that is configured for attachment to the tabletop 3 can be configured to attach to a tabletop 3 that has a polygonal structure, a circular structure, or other structure. For instance, the tabletop may be a rectangular structure having a flat upper surface or a circular structure having a flat upper surface. In other embodiments, the tabletop 3 may have a square shape having a flat or slightly inclined or declined upper surface (e.g. an upper surface having an angle of inclination or declination of between 1° and 10°, between 0° and 5° or between 0° and 10°).

The tabletop 3 can be configured so that it includes two components that are separately attached to different sections of the frame so that the tabletop 3 is foldable. For instance, the tabletop 3 may have a first section 3*a* and a second section 3*b*. The first and second sections may be attached together via the frame 2 such that when in the first position, the tabletop 3 has a flat surface or substantially flat surface as the tabletop extends along its length L and width W. The upper surfaces of the first and second sections 3*a* and 3*b* may face upwardly when the tabletop 3 is in its first, unfolded position. The first and second sections 3*a* and 3*b* may be separable along the width W of the tabletop 3 when the tabletop is in the unfolded position. In some embodiments, the first and second sections may each be configured to define half of the area of the upper surface of the tabletop 3 and be separable along an axis that extends about the width W of the tabletop and/or is foldable along the width W of the tabletop. In other embodiments, the first and second sections 3*a* and 3*b* may be separable and/or foldable along an axis that extends along the length L of the tabletop 3 when the tabletop is in its unfolded position and may each be configured to define half of the area of the upper surface of the tabletop 3 when the tabletop 3 is in the unfolded position. In yet other embodiments, the tabletop's first and second sections may each be configured to take up less or more than half of the area of the upper surface of the tabletop 3 when the tabletop is in the unfolded position (e.g. the first section 3*a* or second section 3*b* may define more than half of the area of the upper surface of the tabletop 3 when it is in the unfolded position and the other of the first and second section may define less than half of this area).

The first and second sections 3*a* and 3*b* may also be separable from each other so that the tabletop 3 is foldable into a second position. When in the second folded position, the upper surface of the first section 3*a* may face a direction that is opposite the direction at which the upper surface of the second section 3*b* faces (e.g. first section 3*a* faces right while the second section 3*b* faces left, the first section 3*a* faces forwardly while the second section 3*b* faces rearwardly, etc.).

The frame 2 of the article of furniture may also be attached to a locking device 11 and/or a folding mechanism 10. The locking device 11 may be connected to the frame 2 and/or folding mechanism 10 and be adjustable between a locked position and an unlocked position. When the locking device 11 is in the locked position, the frame 2 and/or folding mechanism 10 may be prevented from being moved so that the tabletop is prevented from being moved from the first position to the second position. When the locking device is moved to the unlocked position, a user may be able to provide a force that causes the first and second sections 3*a* and 3*b* of the tabletop to fold to place the tabletop 3 into its second folded position. The frame 2 attached to the tabletop 3 and the legs 8 may also move when the tabletop 3 is folded.

For instance, the folding mechanism 10 may be connected to the locking device 11 so that the folding mechanism 10 can be actuated to allow folding of the tabletop from the first position to the second position when the locking device 11 is moved into an unlocked position. When the locking device 11 is moved to its locked position, the folding mechanism 10 may be prevented from articulating to allow folding of the first and second sections 3*a*, 3*b* of the tabletop 3.

The locking device 11 can include a knob that is rotatable to rotate a detent into and out of engagement with one or more teeth of at least one gear of a gear assembly or other portion of a hinge element connecting the first and second sections 3*a* and 3*b* of the tabletop 3. In other embodiments, the locking device may include a knob or other type of handle that is moveable linearly to cause a rod or other type of member to move into and out of engagement with at least one gear of a gear assembly or other portion of a hinge element for locking and unlocking rotatable motion of the first and second sections 3*a* and 3*b* of the tabletop. In some embodiments, the locking device 11 can include a bar or other rigid element that may extend along a length of a hinge assembly to prevent rotation of the hinge assembly and thereby prevent folding of the tabletop 3. For instance, a bar or rod that is actuatable via an actuator connected thereto can be moveable linearly along a first elongated member 37*a* and onto portions of at least a first hinge 13*a* of a hinge assembly to lock motion of the first hinge 13*a*. That member may be moveable from that locking position to an unlocked position such that the rigid member is moved away from the first hinge 13*a* sufficiently to permit rotation of hinges for folding of the tabletop 3.

In yet other embodiments of the locking device 11, the locking device 11 may include a plurality of friction disks that can be tightened or loosened relative to each other via rotation or linear motion of a connector connecting a portion of a hinge assembly to the friction discs. The fiction discs may engage a moveable portion of a hinge assembly to induce friction for locking the position of the hinge assembly to prevent folding and may be tightened or loosened via manipulation of an actuator connected to the friction discs via a connector. The friction discs can be positioned next to each other on the connector such that loosening of the friction discs sufficiently can result in placing such a locking device in an unlocked position and tightening of the friction discs can place the device in a locking position for preventing folding via hinge motion. For instance, the friction discs may be tightened to engage at least one hinge to prevent rotation of a first hinge portion relative to another hinge portion so that the tabletop is unable to be moved out of its unfolded position when the locking device is in its locked position and the friction discs are tightly located next to each other for locking of the hinge's motion. In some embodiments, rotation of the connector in a first direction can effect loosening of the friction discs and rotation of the connector in an opposite second direction can effect tightening of the friction discs. Manipulation of an actuator connected to such a connector can be configured to impart such rotation on the connector.

The folding mechanism 10 may include a plurality of linearly aligned, spaced apart hinges. In some embodiments, the array of hinges can include a first hinge 13*a*, a second hinge 13*b* and a third hinge 13*c*. Each hinge may be spaced apart from the other hinges and have an axle or other axis of rotation for that hinge that is aligned with the axis of ration of all the other hinges. The second hinge 13*b* can be positioned between the first and third hinges 13*a* and 13*c*. The first hinge may be located adjacent the first side of the tabletop 3 and the third hinge 13*c* may be located adjacent to the second side of the tabletop 3. The second hinge 13*b* can be located adjacent to a central or middle portion of the tabletop 3 between the first and third hinges 13*a* and 13*c*. The first, second, and third hinges 13*a*-13*c* may each be connected to the frame such that the fame has a first section 3*a* that is moveable relative to a second section 3*b* about an axis of rotation defined by the linearly aligned axes of rotation of the hinges. The axes of rotation of the hinges can define a horizontal axis of rotation about which the first and second sections 3*a* and 3*b* of the tabletop are rotatable. This horizontal axis can extend along the width W of the tabletop 3 when the tabletop 3 is in the unfolded position. In other embodiments, the horizontal axis of rotation defined by the spaced apart hinges may extend along the length L of the tabletop 3.

The first hinge 13*a* can have a first portion 44*a* that is rotatably connected to a second portion 46*a*. The second hinge 13*b* can have a first portion 44*b* that is rotatably attached to a second portion 46*b*. The third hinge 13*c* can have a first portion 44*c* that is rotatably attached to a second portion 46*c*. The rotational axis for each hinge may be parallel to the rotational axis of the other hinges and be linearly aligned with those axes to define a single axis of rotation about which a tabletop 3 is folded and unfolded via motion of first and second sections 3*a* and 3*b* of the tabletop between unfolded and folded positions. The first section 3*a* of the tabletop 3 can be attached to the first portions 44*a*, 44*b*, and 44*c* of the hinges and the second section 3*b* of the tabletop 3 may be attached to the second portions 46*a*, 46*b*, 46*c* of the hinges so that motion of the first portions relative to the second portions about the rotational axes of the hinges results in the proximate edges of the first and second sections 3*a* and 3*b* that are next to each other when the tabletop 3 is in the unfolded first position moving away from each other as the tabletop is moved from an unfolded position shown in FIGS. 1-4 to a folded position and results in these proximate edges of the first and second sections 3*a* and 3*b* moving toward each other until the tabletop is moved to its unfolded first position in which the proximate edges of the first and second sections 3*a* and 3*b* face toward each other.

When in the unfolded position, the proximate edges of the first and second sections 3*a* and 3*b* of the tabletop 3 may contact each other or may otherwise be located adjacent to each other (e.g. separated by a gap of between 0.01 centimeters to three centimeters, a gap of between 0.1 to 2 centimeters, etc.) as they face toward each other. When the first and second sections 3*a*, 3*b* of the tabletop are moved so that the tabletop 3 is in its folded position, the proximate edges may be configured to face in the same direction (e.g. upwardly, downwardly, or sidewardly in the same direction) and may not face toward each other.

The folding mechanism 10 can include a plurality of arms positioned between the spaced apart linearly aligned hinges. These arms may each be located below the tabletop 3 when the tabletop is in its unfolded position. For instance, a first arm 15 and second arm 17 may extend between the first and second hinges 13*a* and 13*b*. As another example, a third arm 16 and a fourth arm 18 may extend between the second hinge 13*b* and the third hinge 13*c*. The first and third arms 15 and 16 may be attached to the first section 3*a* of the tabletop via their attachment to the hinges and the second and fourth arms 17 and 18 may be attached to the second section 3*b* of the tabletop 3 via their attachment to the hinges. In some embodiments, the first and third arms 15 and 16 may be sections of a single unitary beam, member, or other type of arm structure that extends from the first hinge 13*a* to the third hinge 13*c* and the second and fourth arms 17 and 18 may be sections of a single unitary beam, rail, or other type of arm that extends from the first hinge 13*a* to the third hinge 13*c*. In other embodiments, the first, second, third, and fourth arms 15, 17, 16, and 18 may each be a separate arm structure that extends between different hinges, such as between the second hinge 13*b* and either the first hinge 13*a* or third hinge 13*c*.

Additionally, the frame 2 can include elongated frame elements that extend from the hinges as well as other frame elements that can be configured to attach to the tabletop 3 for supporting the tabletop 3. For instance, the frame 2 can include a first elongated member 37*a* that is attached to the first portion 44*a* of the first hinge 13*a* adjacent a first end of that first elongated member 37*a*, a second elongated member 35*a* attached to the second portion 46*a* of the first hinge 13*a* adjacent a first end of the second elongated member 35*a*, a third elongated member 37*c* that is attached to the first portion 44*c* of the third hinge 13*c* adjacent a first end of that third elongated member 37*c*, and a fourth elongated member 35*c* attached to the second portion 46*c* of the third hinge 13*c* adjacent a first end of the fourth elongated member 35*c*. The frame may also include transversely extending first and second end members 41*a* and 41*b*. The first end member 41*a* may extend between the first and third elongated members 37*a* and 37*c* adjacent the rear end 3*f* of the tabletop and have its opposite ends connected to the second ends of the first and third elongated members 37*a* and 37*c* adjacent to the second ends of these members. The second end member 41*b* can extend between the second elongated member 35*a* and the fourth elongated member 37*c* adjacent the front end 3*e* of the tabletop 3 and have its opposite ends connected to the second and fourth elongated members 35*a* and 35*c* adjacent the second ends of these members.

There may also be at least one cross member that extends between the first and third elongated members 37*a* and 37*c* and also at least one additional cross member that extends between the second and fourth elongated members 35*a* and 35*c*, such as first and second cross members 41*c* and 41*d*. The first and second cross members 41*c* and 41*d* may have opposite ends that are connected to the different members that they extend between. For instance, a first end of the first cross member 41*c* can be attached to the first elongated member 37*a* and the second end of the first cross member 41*c* can be attached to the third elongated member 37*c*. The first end of the second cross member 41*d* can be attached to the second elongated member 35*a* and the second end of the second cross member 41*d* can be attached to the fourth elongated member 35*c*. The first and second cross members 41*c* and 41*d* may be connected to the elongated frame members such that they are positioned near the hinges. For instance, the cross members may be positioned near the second hinge 13*b* such that there is a gap between the first portion 44*b* of the second hinge 13*b* and a middle portion of the first cross member 41*c* and a gap between the second portion 46*b* of the second hinge 13*b* and a middle portion of the second cross member 41*d*.

The cross members, end members, and elongated members of the frame 2 can each be configured so that the tabletop may be attached to each of those members. Fasteners, adhesives and/or other types of fastening mechanisms may be used for connecting the bottom surface of the tabletop 3 to the elongated members, end members, and the cross members.

Different sections of the tabletop may be separately fastened or otherwise attached to different elongated members, end members, and cross members so that the first section 3*a* and the second section 3*b* may be separated (or further separated for embodiments where there maybe a gap between the proximate edges of the first and second sections 3*a* and 3*b* when the tabletop 3 is in the unfolded position) when the tabletop 3 is moved from the unfolded position to the folded position. For example, the first section 3*a* of the tabletop may be a polygonal shaped or other shaped top structure that is attached to the second elongated member 35*a*, the fourth elongated member 35*c*, the second end member 41*b*, the second cross member 41*d*, and the second portions 46*a*, 46*b*, and 46*c* of the first, second, and third hinges 13*a*, 13*b*, and 13*c*. The second section 3*b* of the tabletop 3 can be attached to the first and third elongated members 37*a* and 37*c*, the first end member 41*a*, the first cross member 41*c*, and the first portions 44*a*, 44*b*, and 44*c* of the first, second and third hinges 13*a*, 13*b*, and 13*c*.

The folding mechanism 10 can also include angled elongated members that may extend from the second hinge 13*b* to the base 5 or from a respective one of the cross members to the base 5. For instance, the folding mechanism 10 can include a fifth elongated member 39*a* and a sixth elongated member 39*b*. These angled fifth and sixth elongated members 39*a* and 39*b* may not be directly attached to the tabletop 3, but may be connected to the tabletop via one or more hinges and/or other portions of the frame 2.

The fifth elongated member 39*a* may extend from adjacent the second portion 46*b* of the second hinge 13*b* and/or from the second cross member 41*d* to a first portion 25*a* of a first leg 8*a* of the base and the sixth elongated member 39*b* may extend from adjacent the first portion 44*b* of the second hinge 13*b* and/or the first cross member 41*c* to a first portion 25*b* of a second leg 8*b* that is opposite the first leg. The first leg 8*a* may be adjacent the rear end of the tabletop and the second leg may be adjacent the front end 3*e* of the tabletop. The first leg 8*a* may be attached to respective feet 7 and the second leg 8*b* may also be attached to respective feet 7 for supporting the tabletop 3 on a floor. The fifth elongated member 39*a* may have a first end pivotally attached to the second portion 46*b* of the second hinge 13*b* or the second cross member 41*d* and may have a second end opposite its first end pivotally attached to the first portion 25*a* of the first leg 8*a*. The sixth elongated member 39*b* may have a first end pivotally attached to the first portion 44*b* of the second hinge 13*b* or the first cross member 41*c* and have its second end opposite its first end pivotally attached to the first portion 25*b* of the second leg 8*b*.

During folding of the tabletop, the fifth and sixth elongated members 39*a* and 39*b* may be rotated about their pivotal connections to facilitate motion of the legs 8 so that the legs 8 move closer to each other during folding of the tabletop 3 and move farther away from each other during unfolding of the tabletop 3 while the legs are slideable or horizontally moveable along a flooring surface. The orientation of the fifth and sixth elongated members may change during the motion of the tabletop between folded and unfolded positions. For instance, when moved to the folded position, the fifth and sixth elongated members may each be pivoted such that these members extend substantially vertically or more vertically when the tabletop 3 is in its folded position as compared to their orientation when the tabletop 3 is in the unfolded position and the fifth and sixth elongated members may be oriented to extend more horizontally when the tabletop 3 is in its unfolded position as compared to when the tabletop 3 is in its folded position.

A plurality of spring elements may be part of the folding mechanism 10. The spring elements may be attached to the frame 2 and to the hinges to facilitate the folding and unfolding of the tabletop 3 such that the unfolding motion of the first and second sections 3*a* and 3*b* of the tabletop occurs via a force provided by a user that acts against a biasing force provided by the spring elements to reduce the chances that a user may accidentally have his or her finger or hand caught between the first and second sections 3*a* and 3*b*, which could cause the user's finger or hand to become hurt. Such a biasing force provided by the spring elements can also help a user fold the tabletop by providing a biasing force that biases the first and second sections 3*a* and 3*b* of the tabletop to rotate toward their folded positions. In some embodiments, the biasing force provided by the spring elements may be sufficient to partially move the first and second sections toward their folded positions (e.g. provide a force for moving the first and second sections 5-10% of their way from their unfolded positions to their folded positions, etc.).

The spring elements may include a first spring element 21*a*, a second spring element 23*a*, a third spring element 21*c*, a fourth spring element 23*c*, a fifth spring element 23*d*, a sixth spring element 23*e*, a seventh spring element 23*f* and an eighth spring element 23*g*. The first spring element 21*a* can be connected to the first portion 44*a* of the first hinge 13*a* and the second arm 17. The second spring element 23*a* can be connected to the second portion 46*a* of the first hinge 13*a* and the first arm 15. The third spring element 21*c* can be connected to the fourth arm 18 and the first portion 44*c* of the third hinge 13*c*. The fourth spring element 23*c* can be connected to the third arm 16 and the second portion 46*c* of the third hinge 13*c*. The fifth spring element 23*d* can be connected to the first arm 15 and the second portion 46*b* of the second hinge 13*b*. The sixth spring element 23*e* can be connected to the third arm 16 and the second portion 46*b* of the second hinge 13*b*. The seventh spring element 23*f* can be connected to the first portion 44*b* of the second hinge 13*b* and the second arm 17. The eighth spring element 23*g* can be connected to the fourth arm 18 and the first portion 44*b* of the second hinge 13*b*.

In some embodiments, the spring elements may each be a torsion spring. For instance, in some embodiments the first spring element 21*a* can be a torsion spring having a first end 28 connected to the first portion 44*a* of the first hinge 13*a* and a second end 26 connected to the second arm 17. The second spring element 23*a* can be a torsion spring having a first end 28 connected to the second portion 46*a* of the first hinge 13*a* and a second end 26 connected to the first arm 15. The third spring element 21*c* can be a torsion spring having its first end 28 connected to the first portion 44*c* of the third hinge 13*c* and its second end 26 connected to the fourth arm 18. The fourth spring element 23*c* can be a torsion spring having its first end 28 connected to the second portion 46*c* of the third hinge 13*c* and its second end 26 connected to the third arm 16. The fifth spring element 23*d* can be a torsion spring having its first end connected to the second portion 46*b* of the second hinge 13*b* and its second end 24 connected to the first arm 15. The sixth spring element 23*e* can be a torsion spring having its first end connected to the second portion 46*b* of the second hinge 13*b* and its second end 24 connected to the third arm 16. The seventh spring element 23*f* can be a torsion spring having its first end connected to the first portion 44*b* of the second hinge 13*b* and its second end 24 connected to the second arm 17. The eighth spring element 23*g* can be a torsion spring having its first end connected to the first portion 44*b* of the second hinge 13*b* and it second end 24 connected to the fourth arm 18. In other embodiments, it is contemplated the first through eighth spring elements could each be a different type of spring, such as a type of elastomeric spring or other type of spring element. In some embodiments, the first and second ends of the spring elements may be structured as tangs or other type of structure for facilitating connection of that end to within a slot or other aperture that is sized to receive and retain that end for connection of that end to an arm or hinge portion.

Additionally, the folding mechanism 10 can include spring elements that are connected between the base 5 and elongated members of the frame 2 such that these spring elements also contribute to the biasing force for biasing the tabletop 3 toward its folded position. For example, each leg 8 can include spring elements 8*c* that are attached between the leg 8 and opposite frame members 35*a* and 35*c* or opposite frame members 37*a* and 37*c*.

For instance, each leg 8 can be attached to a horizontally elongated support member 8*d*. A respective spring element 8*c* can be positioned adjacent to each end of the support member 8*d* that is configured to be connected between that end of the support member and a frame member to which that end of the support member is pivotally connected. For instance, the support member 8*d* attached to the first leg 8*a* can have its opposite ends pivotally connected to the first and third frame members 37*a* and 37*c*. Spring elements 8*c* can be connected between these pivotal connections and the support member 8*d*.

For instance, a ninth spring element 8*e* can have its first end connected to the second elongated frame member 35*a* and its second end opposite its first end connected to a first end of the support member 8*d*. A tenth spring element 8*f* can have its first end connected to the fourth elongated frame member 35*c* and have its second end attached to the second end of the support member 8*d*. The ninth and tenth spring elements may each be configured as torsion springs in some embodiments and be connected between the support member 8*d* and the second and fourth elongated members 35*a* and 35*c* of the frame to provide a biasing force for biasing motion of the first section 3*a* of the tabletop 3 toward its folded position.

The second leg 8*b* could also include such spring elements that are arranged similarly to the ninth and tenth spring elements 8*e* and 8*f* that are connected to the first leg 8*a*. For instance, the horizontally elongated support member 8*d* that is attached to the second leg 8*b* can include an eleventh spring element that has its first end connected to the first elongated frame member 37*a* and its second end connected to a first end of the support member 8*d*. A twelfth spring element can have its first end connected to the third elongated frame member 37*c* and its second end connected to the second end of the support member 8*d*. The eleventh and twelfth spring elements may each be configured as torsion springs in some embodiments.

In some embodiments, it is also contemplated that the folding mechanism 10 can include spring elements attached to the fifth and sixth elongated members 39*a* and 39*b* that are configured to provide a biasing force for biasing the tabletop 3 into its folded position. For instance, the pivotal connection at the first portion 25*a* of the first leg 8*a* may include a thirteenth spring element that has its first end connected to the second end of the fifth elongated member 39*a* and its second end connected the first portion 25*a* of the first leg 8*a*. As another example, the pivotal connection at the first portion 25*b* of the second leg 8*b* can include a fourteenth spring element that has its first end connected to the second end of the sixth elongated member 39*b* and its second end connected to the first portion 25*b* of the second leg 8*b*. The thirteenth and fourteenth spring elements may be torsion springs. In other embodiments, it is contemplated that the thirteenth and fourteenth spring elements may be other types of spring elements.

Gear assemblies 50 may be connected between first and second portions of one or more of the hinges that foldably connect the first and second sections 3*a* and 3*b* of the tabletop 3. For instance, the first hinge 13*a* and the third hinge 13*c* can each be connected to a respective gear assembly 50. Each gear assembly 50 can be configured to extend between first and second portions of a respective one of the hinges to help ensure that each portion of the hinge to which it is connected rotates in an even, synchronous manner between folded and unfolded positions of the tabletop 3.

Each gear assembly 50 can include a first gear 52, a second gear 54, a third gear 56 and a fourth gear 58. In some embodiments, the gears may each be configured as a spur gear, a worm gear or as a miter gear. Each gear can include teeth that extend away from a gear body to distal ends of the teeth. The teeth can be spaced apart from each other so that teeth from one gear can intermesh with the teeth of at least one other gear of the gear assembly so that rotation of that gear causes other gears to which that gear's teeth intermesh to also rotate. For example, the first gear 52 may have teeth that intermesh with teeth of the second gear 54. Teeth of the second gear 54 can also intermesh with teeth of the third gear 56. The teeth of third gear 56 can also intermesh with the teeth of the fourth gear 58. Rotation of the first gear 52 can result in rotation of the fourth gear 58 via rotation of the second and third gears driven by rotation of the first gear 52 and the intermeshed teeth of the gears. Rotation of the fourth gear 58 can also result in rotation of the first gear 52 via rotation of the second and third gears 54 and 56 that are driven by rotation of the fourth gear 58 and the intermeshed teeth of the gears.

Each gear assembly 50 can be configured so that movement of a portion of a hinge to fold the tabletop 3 or unfold the first and second sections 3*a* and 3*b* of the tabletop 3 results in the gears of the gear assembly rotating. The gear assembly 50 can be configured to couple first and second portions of a hinge so that each portion is rotatable relative to the other portion in a synchronous and even manner so that each portion moves at substantially the same rate of speed and so that the folding and unfolding motion of the first and second sections 3*a* and 3*b* of the tabletop occurs at the same time and at the same rate of speed or at substantially the same rate of speed (e.g. within 10%, within 5% or within 5%-15% of the rate of rotational speed of the other section).

For example, when the first portion 44*a* of the first hinge is caused to rotate by a user applying a force to fold the tabletop 3 from its unfolded position to its folded position, the first portion 44*a* of the first hinge 13*a* may begin to rotate due to a downward application of force on the first section 3*a* of the tabletop (e.g. a force applied downwardly by a user adjacent the front end 3*e* of the tabletop). Rotation of the first portion 44*a* can cause a first gear of the gear assembly to rotate via a connection of that first gear to the first portion 44*a*. Rotation of that gear may result in the other gears of the gear assembly also rotating via their intermeshed teeth so that the second portion 44*c* of the first hinge 13*a* also rotates at the same time and at a substantially same rate of speed as the first portion 44*a* of the first hinge 13*a*.

Such a downward force applied by a user adjacent to the front end of the first section 3*a* can also drive rotation of the first portion 44*c* of the third hinge 13*c* relative to the second portion 46*c* of the third hinge 13*c*. A gear assembly 50 connected between these two portions can cause that rotation to also occur at substantially the same time and at substantially the same speed as the rates of rotation of the portions of the first hinge 13*a*.

As another example, when the second portion 46*c* of the third hinge 13*c* is caused to rotate by a user applying a force to unfold the tabletop 3 from its folded position to its unfolded position, the second portion 46*c* of the third hinge 13*c* may be rotated relative to the first portion 44*c* of the third hinge synchronously and at substantially the same rate of speed via a gear assembly 50 connected between these portions of the third hinge 13*c*. The force provided by a user may be a pulling force applied to the rear end 3*f* of the tabletop 3, which may be a lower edge of the second section 3*b* of the tabletop when the tabletop 3 is in the folded position. Rotation of the second portion 46*c* can cause a fourth gear 58 of the gear assembly 50 to rotate via a connection of that fourth gear 58 to the second portion 46*c*. Rotation of that fourth gear 58 may result in the other gears of the gear assembly also rotating via their intermeshed teeth so that the first portion 44*c* of the third hinge 13*c* also rotates at the same time and at a substantially same rate of speed as the second portion 46*c* of the third hinge 13*c*.

Such a pulling force applied by a user adjacent to the rear end 3*f* of the tabletop when the second section 3*b* of the tabletop is in the folded position can also drive rotation of the second portion 46*a* of the first hinge 13*a* relative to the first portion 44*a* of the first hinge 13*a*. A gear assembly 50 connected between these two portions can cause that rotation to also occur at substantially the same time and at substantially the same speed as the rates of rotation of the portions of the third hinge 13*c*.

The first and second portions of the other hinges may also rotate in the same way at substantially the same speed. Only one gear assembly may be used to connect different portions of only one of the hinges to help provide such synchronous motion and speed of the folding and unfolding. In other embodiments, there may be at least two gear assemblies 50, such as a first gear assembly positioned between the first and second portions of the first hinge 13*a* and a second gear assembly positioned between the first and second portions of the third hinge 13*c*. In yet other embodiments, there may also be a third gear assembly connected between the first and second portions of the second hinge 13*b*.

The frame 2 having first and second foldable sections attached, respectively, to the first and second foldable sections 3*a* and 3*b* of the tabletop 3, can be operated by a user to fold the article of furniture from a use position in which the tabletop is unfolded and is supported for use by one or more users to a folded position in which the tabletop's first and second sections 3*a* and 3*b* are folded via folding mechanism 10. Such folding of the article of furniture may also result in the base 5 changing its configuration. For instance, legs 8 may be repositioned during the folding of the tabletop 3. Such repositioning of the legs 8 may occur as the tabletop is folded and may be configured to result in the height of the hinges being increased such that the axis of rotation defined by the aligned axes of rotation of the hinges are increased at the same time the tabletop is folded. The folding mechanism 10 may be actuated by a user after the user adjusts the locking device 11 to its unlocked position.

The locking device 11 can include a handle or other type of actuator that is rotatable, linearly moveable, or pivotable to adjust the position of the locking device from its locked position to an unlocked position. The locking device may be connected to one or more of the hinges to prevent the first portions of the hinges from rotating relative to the second portions of those hinges about their axes of rotation when the locking device 11 is in the locked position. A linkage assembly or other element may be coupled to the handle or other actuator of the locking device so that motion of the handle moves the linkage assembly or other element for adjusting the position of the locking device between its locked and unlocked positions.

To fold the tabletop, the user may first adjust the locking device 11 to its unlocked position via manipulation of the handle of the locking device. Thereafter, a user may provide a force on the first or second section 3*a* or 3*b* of the tabletop 3 to cause that section to rotate about the axles of the first, second, and third hinges 13*a*-13*c* that define the horizontal axis of rotation for the first and second sections 3*a* and 3*b* until the first section 3*a* of the tabletop and second section 3*b* of the tabletop 3 are moved to their folded positions. Their folded positions may orient each section of the tabletop to having their lengths extend parallel or substantially parallel (e.g. within 15° of being parallel or within 20° of being parallel) to each other and also have their widths extend parallel or substantially parallel to each other. In other embodiments, the folded position may result in the first and second sections 3*a* and 3*b* being pivoted such that the feet attached to the first leg 8*a* are moved closer to the feet attached to the second leg 8*b* via sliding or rolling along a floor so that the article of furniture takes up less area of a floor space when in the folded position. This motion of the legs 8 can also result in the height of the hinges being increased.

During folding of the tabletop 3, the first and second portions of the hinges 44*a*-44*c* and 46*a*-46*c* may each rotate about their axes of rotation. Gear assemblies 50 that may be connected between the first and second portions of at least one of the first hinge 13*a* and the third hinge 13*c* can help control and regulate the speed of rotation and the synchronous motion of the first and second sections 3*a* and 3*b* as they are moved from their unfolded positions to their folded positions. The rotation of these portions of the hinges may cause the first through fourth elongated members 37*a*, 35*a*, 37*c*, and 35*c* to move about the axis of rotation defined by the axes of the hinges. The first and second end members 41*a* and 41*b* and the first and second cross members 41*c* and 41*d* may also be rotated about this horizontal axis defined by the hinges' axes of rotation. Rotation of the hinges and/or first and second cross members 41*c* and 41*d* can also cause the fifth and sixth elongated members 39*a* and 39*b* to be moved so that the first and second legs 8*a* and 8*b* are moved closer together by rolling or sliding of the feet along a floor via the motion of the fifth and sixth elongated member while the tabletop 3 is being folded, which can result in the height of the hinges being increased as the legs 8 are moved close together. In some embodiments, the fifth and sixth elongated members 39*a* and 39*b* may be positioned to move from an angled position that extends substantially horizontally and vertically from adjacent the second hinge 13*b* to adjacent a foot 8, to generally vertical positions in which the fifth and sixth elongated members 39*a* and 39*b* extend vertically or substantially vertically (e.g. within 10° of being perfectly vertical or within 5° of being perfectly vertical, etc.) when the tabletop 3 is adjusted to its folded position when the feet engage a floor.

The first through eighth spring elements (or first through twelfth spring elements or first through fourteenth spring elements for certain embodiments that may have more than eight spring elements) can be configured to provide a biasing force on the rotation of the hinges as the tabletop is moved to its folded position so that the hinges rotate at or below a pre-selected speed range for at least a portion of the travel of the first and second sections between their unfolded and folded positions. Such biasing of the rotational motion of the hinges can provide multiple advantages. For instance, it can require a user to provide sufficient force to intentionally change the position of the article of furniture. As another example, such biasing can result in the first and second sections of the tabletop being moved at a reasonable speed by a user without the user having to individually push against the entire weight of the article so that a user is not overly strained with folding of the tabletop. This can allow the user to also sufficiently control his or her actions so that the user has sufficient control for better avoiding having a finger or hand caught in any pinch points, such as between the first and second sections 3*a* and 3*b* of the tabletop 3. Gear assemblies 50 connected between first and second portions of at least one of the hinges may also help synchronize motion and the rate of speed at which the first and second sections 3*a* and 3*b* of the tabletop 3 are moved during the folding of the tabletop 3.

In some embodiments, use of the array of spring elements in the folding mechanism can be configured to allow for article of furniture to be designed so that folding of the article of furniture from an unfolded position to a folded position and vice versa can occur without use of exposed, long coil springs that may extend along the entire length of a tabletop. Such coil springs can be aesthetically undesirable to some users. Further, such coil springs can pose hazards to a user as possible pinch points or entanglement points can exist by such long exposed coil springs. Embodiments of the article of furniture in which the first through eighth, first through twelfth, or first through fourteenth spring elements are torsion springs can allow for a sleek, clean aesthetic affect for the article while also avoiding any problems that can be posed be long, exposed coil springs. In other embodiments, each of the spring elements may be another type of spring that is connected between different components for controlling a rate of rotation at which the hinge portions may rotate and/or at which the fifth and sixth elongated members 39*a* and 39*b* may rotate that are contained within housings to avoid exposed pinch points. Such spring elements can also be configured to provide a clean, sleek aesthetic affect that has a substantially different effect than exposed, long coil springs.

After being moved to the folded position, some embodiments of the article of furniture may be configured to permit the locking device to be again actuated to the locked position to prevent rotation of the hinges to lock the article of furniture in its folded position (e.g. motion of the locking device may result in engagement with a gear of a gear assembly to prevent rotation of the gear for locking the position of the sections of the tabletop). Other embodiments may either not have a locking device that is able to lock the folded position of the tabletop or have a separate folded position locking device that can be actuated to prevent unwanted unfolding of the folded article of furniture. Yet other embodiments of the article of furniture may not include a locking device 11 so that adjustment of the positioning of the locking device 11 is not needed.

The folded article of furniture may be moved to a desired location for storage. If the feet 7 are castors they article may be rolled by a user to a desired storage position along a floor. If the feet 7 are stationary feet (e.g. glides), then a user may slide the article or may work individually or with others to lift and move the folded article to a desired location for storage.

After being stored, the article of furniture may be needed again for use by one or more users. The article may then be taken from where it was stored and moved to a desired position. Thereafter, a user may adjust the locking device to an unlocked position (if such a locking device was previously set to a locked position after the tabletop was folded) and then provide a pulling force and/or other force to at least one of the first and second sections 3*a* or 3*b* of the tabletop to cause the tabletop sections to rotate about the axis of rotation defined by the axes of the hinges (e.g. the aligned axes of rotation of the first, second, and third hinges 13*a*, 13*b*, and 13*c*). The legs 8 may also move away from each other as the tabletop 3 is unfolded such that the height of the hinges decreases during the unfolding of the tabletop 3. One or more gear assemblies connected between first and second portions of one or more of the hinges may help control the synchronous motion of the first and second sections and the rate at which these sections rotate relative to each other as the sections move as the tabletop 3 is moved from its folded position to its unfolded position.

In some embodiments, at least one damper may be positioned for attachment to at least one of the first and second sections 3*a* and 3*b* and the frame 2 or base 5. Each damper can be configured to provide a biasing force acting against motion of the first and second sections to their unfolded positions prior to the first and second sections being moved into their unfolded positions such that their proximate ends contact each other or are near each other (e.g. the proximate ends face each other with a gap of between 0.01 centimeter to 1 centimeter separating these ends). Each damper may be configured to provide a counterforce to complete the motion of the proximate ends for having the first and second sections fully moved to their unfolded positions so that a user is required to provide an additional downward force adjacent the proximate ends of the first and second sections 3*a* and 3*b* to work against the damper(s) to move the first and second sections to their unfolded positions to complete the unfolding of the tabletop. Each damper can be configured to provide such a counterforce when the first and second sections 3*a* and 3*b* are very close to being in their unfolded positions (e.g. within 5% of 10% of being in their unfolded positions). By the damper(s) being so positioned and configured, a user's fingers may be prevented from being accidentally injured or smashed between the proximate ends of the first and second sections 3*a* and 3*b* when moving the tabletop 3 to its unfolded position as the user will have time to ensure his or her hands are clear of this pinch point area and be required to provide an additional force for fully moving the tabletop to its unfolded position.

For embodiments having at least one such damper, a user may be required to provide a downward force after having pulled the first and second sections 3*a* and 3*b* to positions that are near their unfolded positions. That downward force may be provided near the proximate ends of the first and second sections. This downward force may be greater than the force provided by the one or more dampers (e.g. gas spring or other type of damper) to move the first and second sections to their unfolded positions.

Once the tabletop sections are moved to their unfolded positions, the locking device may be manipulated to move the locking device to its locked position via manipulation of a handle or other actuator. Thereafter, the supported tabletop 3 of the article of furniture may be put to a use (e.g. holding work papers, computers, providing a work surface supported by the base for other tasks, etc.).

It should be appreciated that embodiments of the article of furniture and folding mechanism may be modified to meet various different design criteria. For example, the elongated members of the frame 2, the end members of the frame, the cross members of the frame 2 and the elongated members of the folding mechanism 10 can each be any type of elongated member composed of any type of suitable material such as rods, bars, rails, beams, or other type of elongated member made of wood, metal, polymeric material, a composite material or other type of material. As another example, it should be appreciated that more than three hinges or less than three hinges may be utilized in an embodiment of the article of furniture and/or folding mechanism. For example, some embodiments may only have two hinges and other embodiments may have four or five hinges. In embodiments having only two hinges, the two hinges may be the first and third hinges 13*a* and 13*c*, in which case the third hinge 13*c* could be considered a second hinge). As yet another example, the tabletop 3 can be composed of any type of suitable material such as metal, wood, polymeric material, a composite material or other type of material. As yet another example, the base 5 of the article of furniture may have any of a number of different designs for supporting the article on a floor. For instance, there may be more than two legs for certain base designs. As another example, each leg 8 of the base 5 may be attached to only one foot or may be attached to multiple different feet 7. As yet another example, the shape, length, and width of each leg may be any of number of suitable configurations and include multiple different angled segments to provide a particular aesthetic effect and/or meet other design criteria. As yet another example, first and second portions of the first and third hinges 13*a* and 13*c* can be configured as separate elements that are fastened to elongated frame members or may be integral to such frame members. Additionally, it should be understood that for some embodiments elements of the frame 2 can also be considered to be components of the folding mechanism 10 (e.g. first, second, third and fourth elongated members 37*a*, 35*a*, 37*c* and 37*c* and first and second cross members 41*c* and 41*d*). As yet another example, the frame 2 and the tabletop 3 may be sized and configured to have any type of desired shape to meet a particular set of design criteria such as, for example, a circular shape, polygonal shape, irregular shape, oblong shape, or other type of shape or structure. As yet another example, embodiments of the article of furniture may not include a locking device 11.

Therefore, it should be understood that while certain exemplary embodiments of articles of furniture and folding mechanisms for articles of furniture and methods of making and using the same have been discussed and illustrated herein, it is to be distinctly understood that the invention is not limited thereto but may be otherwise variously embodied and practiced within the scope of the following claims.

What is claimed is:

1. An article of furniture comprising:

a base;

a frame connected to the base;

a tabletop connected to the frame; and a folding mechanism connected to at least one of the frame and the tabletop such that a first section of the tabletop and a second section of the tabletop are moveable relative to each other so that the tabletop is moveable from an unfolded position to a folded position, the folding mechanism comprising:

a plurality of hinges and a plurality of spring elements attached to the hinges, the hinges comprising: a first hinge, a second hinge, and a third hinge, the second hinge being between the first and third hinges, the hinges being spaced apart from each other, each of the hinges having a first portion that is rotatable relative to a second portion about an axis of rotation, the axis of rotation of the first hinge being aligned with the axis of rotation of the second hinge and the axis of rotation of the third hinge to define an axis of rotation about which the first section of the tabletop is rotatable when the tabletop is moved from the unfolded position to the folded position; and wherein the folding mechanism also comprises:

a first arm;

a second arm;

a third arm; and a fourth arm; and wherein the spring elements comprise:

a first spring element connected between the first portion of the first hinge and the second arm, a second spring element connected between the second portion of the first hinge and the first arm;

a third spring element connected between the first portion of the third hinge and the fourth arm, a fourth spring element connected between the second portion of the third hinge and the third arm;

a fifth spring element connected between the second portion of the second hinge and the first arm;

a sixth spring element connected between the second portion of the second hinge and the third arm;

a seventh spring element connected between the first portion of the second hinge and the second arm; and an eight spring element connected between the first portion of the second hinge and the fourth arm.

2. The article of furniture of claim 1, wherein each of the spring elements is comprised of a torsion spring or is a torsion spring.

3. The article of furniture of claim 1 wherein:

the first arm extends between the second portion of the first hinge and the second portion of the second hinge;

the second arm extends between the first portion of the first hinge and the first portion of the second hinge, the first arm being spaced apart from the second arm;

the third arm extends between the second portion of the second hinge and the second portion of the third hinge; and the fourth arm extends between the first portion of the second hinge and the first portion of the third hinge, the fourth arm being spaced apart from the third arm.

4. The article of furniture of claim 3 wherein the frame comprises:

a first cross member positioned adjacent to the first portion of the second hinge and a second cross member positioned adjacent to the second portion of the second hinge.

5. The article of furniture of claim 4, wherein the base comprises:

a first leg and a second leg;

and wherein the folding mechanism also comprises:

a first elongated member extending from the first cross member to the first leg, a first end of the first elongated member rotatably connected to the first cross member and a second end of the first elongated member rotatably connected to the first leg; and a second elongated member extending from the second cross member to the second leg, a first end of the second elongated member rotatably connected to the second cross member and a second end of the second elongated member rotatably connected to the second leg.

6. The article of furniture of claim 5, wherein the folding mechanism also comprises:

a ninth spring element connected between the second end of the first elongated member and the first leg; and a tenth spring element connected between the second end of the second elongated member and the second leg.

7. The article of furniture of claim 6, wherein the first, second, third, fourth, fifth, sixth, seventh, eighth, ninth, and tenth spring elements are each comprised of a torsion spring.

8. The article of furniture of claim 1, wherein the axis of rotation of the first hinge is linearly aligned with the axis of rotation of the second hinge and is also linearly aligned with the axis of rotation of the third hinge.

9. The article of furniture of claim 8, wherein the base is comprised of legs attached to feet, the feet being comprised of castors.

10. The article of furniture of claim 1, wherein the frame is comprised of a first portion connected to the first section of the tabletop and a second portion connected to the second section of the tabletop such that proximate edges of the first and second sections of the tabletop contact each other or are proximate each other when the tabletop is in the unfolded position such that the proximate edges face each other when the tabletop is in the unfolded position and wherein the proximate edges are moved away from each other when the tabletop is adjusted from the unfolded position to the folded position such that the proximate edges face in a same direction when the tabletop is in the folded position.

11. The article of furniture of claim 1, wherein the article is a desk or a table.

12. The article of furniture of claim 1, comprising:

a locking device connected to at least one of the frame and the folding mechanism, the locking device adjustable from a locked position to an unlocked position, the locking device configured to prevent the tabletop from moving from the unfolded position to the folded position when in the locked position.

13. The article of furniture of claim 1, comprising:

a first gear assembly connected between the first portion of the first hinge and the second portion of the first hinge; and a second gear assembly connected between the first portion of the third hinge and the second portion of the third hinge; and wherein the first portion of the first hinge is rotatable relative to the second portion of the first hinge about an axis of rotation and the first portion of the third hinge being rotatable relative to the second portion of the third hinge about an axis of rotation, the axis of rotation of the first hinge being aligned with the axis of rotation of the third hinge to define an axis of rotation about which the first section of the tabletop is rotatable when the tabletop is moved from the unfolded position to the folded position.

14. The article of furniture of claim 13, wherein:

the first arm is positioned below the tabletop when the tabletop is in the unfolded position;

the second arm is positioned below the tabletop when the tabletop is in the unfolded position, the first arm being spaced apart from the second arm;

the third arm is positioned below the tabletop when the tabletop is in the unfolded position; and the fourth arm is positioned below the tabletop when the tabletop is in the unfolded position, the fourth arm being spaced apart from the third arm.

15. A method of using an article of furniture of claim 1, the method, comprising:

adjusting the tabletop from the unfolded position to the folded position; and adjusting the tabletop from the folded position to the unfolded position.

16. The method of claim 15, wherein the adjusting of the tabletop from the unfolded position to the folded position is performed such that a height of the hinges is increased while legs of the article of furniture are moved closer together; and wherein the adjusting of the tabletop from the folded position to the unfolded position is performed such that the height of the hinged decreases while the legs of the article of furniture are moved away from each other.

* * * * *